US009417561B2

(12) United States Patent
Sakamaki

(10) Patent No.: US 9,417,561 B2
(45) Date of Patent: Aug. 16, 2016

(54) DEVELOPING DEVICE

(71) Applicant: CANON KABUSHIKI KAISHA, Tokyo (JP)

(72) Inventor: Tomoyuki Sakamaki, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/566,421

(22) Filed: Dec. 10, 2014

(65) Prior Publication Data

US 2015/0168871 A1 Jun. 18, 2015

(30) Foreign Application Priority Data

Dec. 12, 2013 (JP) ..... 2013-257155

(51) Int. Cl.
*G03G 15/08* (2006.01)

(52) U.S. Cl.
CPC ..... *G03G 15/0893* (2013.01)

(58) Field of Classification Search
CPC ..... G03G 15/0877; G03G 15/0879; G03G 15/0875; G03G 15/0886; G03G 21/12; G03G 15/0872; G03G 15/0865; G03G 15/0893; G03G 21/105; G03G 2215/0668; G03G 2215/0827; G03G 15/0855; G03G 15/0863
See application file for complete search history.

(56) References Cited

U.S. PATENT DOCUMENTS

| | | | | |
|---|---|---|---|---|
| 2011/0008073 | A1* | 1/2011 | Kudo et al. | 399/254 |
| 2011/0158701 | A1* | 6/2011 | Sato | 399/254 |
| 2011/0311279 | A1* | 12/2011 | Okazaki | G03G 15/0887 399/254 |
| 2012/0027470 | A1* | 2/2012 | Kunihiro | 399/273 |

FOREIGN PATENT DOCUMENTS

| | | | |
|---|---|---|---|
| JP | 11-84874 | A | 3/1999 |
| JP | 11-143231 | A | 5/1999 |
| JP | 2008-83409 | A | 4/2008 |
| JP | 2012-42737 | A | 3/2012 |
| JP | 2013-105037 | A | 5/2013 |

* cited by examiner

*Primary Examiner* — Roy Y Yi
(74) *Attorney, Agent, or Firm* — Canon USA, Inc. IP Division

(57) ABSTRACT

In a developing device, the conveying ability of a second screw in a first area that includes an area, which is superposed with, in an axial direction of a developing sleeve, a developer carrying area of the developing sleeve and a downstream communicating portion through which a developer is conveyed from a developing chamber to a collecting chamber, is lower than the conveying ability of the second screw in a second area, which is positioned further downstream than the first area in a direction in which the developer is conveyed and which is superposed with the developer carrying area of the developing sleeve.

7 Claims, 6 Drawing Sheets

DEVELOPING DEVICE

BACKGROUND OF THE INVENTION

1. Field of the Invention

The present invention relates to a developing device that is used in an image forming apparatus such as a copying machine or a laser printer that employs an electrostatic recording method or an electrophotographic method in which an electrostatic image that has been formed on an image-bearing member is developed by using a developer that includes toner and carrier.

2. Description of the Related Art

In the related art, in an image forming apparatus such as a copying machine, an electrostatic latent image that has been formed on a photoconductor drum, which is an image-bearing member, is developed by a developing device in such a manner as to convert the electrostatic latent image into a visible image.

Such a developing device is configured to cause a latent image to be visualized as a toner image by supplying toner to a photoconductor drum, and a developing device in which a two-component developer that is a mixture of non-magnetic toner and magnetic carrier is used as a developer is frequently used in addition to a developing device in which a mono-component developer that contains magnetic toner is used as a developer. In a developing device that uses a two-component developer, the charge amount of toner has good stability, and thus, a color image that has good color tone can be formed. Therefore, such a developing device may be used in color image forming apparatuses.

An example of the above-mentioned developing device is disclosed in Japanese Patent Laid-Open No. 11-143231 (Patent Document 1), and a representative figure thereof is illustrated in FIG. 5.

In a developing device 102, a developing sleeve 120 that includes a cylindrical magnet 121, which is non-rotatably arranged in an opening of a developer container 110 that contains a two-component developer, is disposed in such a manner as to face a photoconductor drum 1. The photoconductor drum 1 rotates in the direction of a corresponding one of arrows in FIG. 5, and the developing sleeve 120 rotates in a direction opposite to the direction in which the photoconductor drum 1 rotates at a facing portion.

The developer, which is contained in the developer container 110, is sucked in and held on the developing sleeve 120 at a position (pumping position) Q on a surface of the developing sleeve 120 that corresponds to the position of a pumping magnetic pole S1 of the magnet 121 by the influence of the pumping magnetic pole S1. Then, the developer reaches a development portion after the layer thickness of the developer has been controlled by a developing blade 122, forms a magnetic brush in the development portion by the influence of a developing magnetic pole N1, and develops a latent image on the photoconductor drum 1.

The developer, whose toner density has been reduced through development, is separated from the developing sleeve 120 and deposited at a position (developer depositing position) P on the surface of the developing sleeve 120 between a releasing magnetic pole S2 and the pumping magnetic pole S1 where the magnetic flux density is low. As described above, the developer is sucked in and held on the developing sleeve 120, from which the developer has been separated, again at the pumping position Q.

In the developer container 110, a developing chamber 125 in which a first stirring conveying member 123 is disposed is formed below the developing sleeve 120, and a stirring chamber 126 in which a second stirring conveying member 124 is disposed is formed in such a manner that a partitioning wall 140 is interposed between the developing chamber 125 and the stirring chamber 126. Each of the first and second stirring conveying members 123 and 124 is a screw-type stirring conveying member, and such a screw-type stirring conveying member generally includes a helical screw blade.

Circulation of the developer in the developing device 102 will be described with reference to FIG. 6. The developing chamber 125 from which the developer is supplied to the developing sleeve 120 and the stirring chamber 126 that is arranged next to the developing chamber 125 in the horizontal direction are separated from each other by the partitioning wall 140 that has end portions 115 and 116 that are open. As indicated by arrows in FIG. 6, the developer is supplied to the developing sleeve 120 while the developer is made to circulate between the developing chamber 125 and the stirring chamber 126 by the first and second stirring conveying members 123 and 124. The developer that has passed through a development region of the photoconductor drum 1 while being carried by the developing sleeve 120 is separated from the developing sleeve 120 and collected so as to be placed in the developing chamber 125 as indicated by dashed arrows in FIG. 6.

In this case, if the developer that has been separated from the developing sleeve 120 and that has a low toner density is not sufficiently stirred by the first stirring conveying member 123 and supplied to the developing sleeve 120 again, the developer develops a latent image on the photoconductor drum 1 while having a low toner density. This causes image density to be unstable, and undesirable effects such as inconsistencies in density are likely to occur.

Accordingly, as a configuration for suppressing the occurrence of the inconsistencies in density due to a developer that has been separated from a developing sleeve and that has a low toner density, a developing device that employs a function separation system such as that disclosed in Japanese Patent Laid-open No. 2012-42737 (Patent Document 2) has been proposed. An exemplary embodiment of the developing device disclosed in Patent Document 2, which employs the function separation system, is illustrated in FIG. 7.

A developing device that employs the function separation system is a developing device that employs a developer circulation system in which a developer is supplied from a developing chamber, in which a first conveying screw is disposed, to a developing sleeve, and in which the developer after completion of development is collected so as to be placed in a stirring chamber in which a second conveying screw is disposed. By employing the function separation system, a developer whose toner density has been reduced as a result of being used for development can be prevented from being supplied to a developing sleeve again while not being sufficiently stirred, and the occurrence of a problem, such as inconsistencies in density as mentioned above, can be suppressed.

However, in a developing device that employs the function separation system such as that disclosed in Patent Document 2, there has been a problem in that uneven distribution of the developer level occurs. This uneven distribution occurs as a result of the developer being collected from the developing sleeve and placed in the stirring chamber.

Circulation of a developer in such a developing device that employs the function separation system will be described with reference to FIG. 8 while being compared with FIG. 6. As indicated by arrows in FIG. 8, the developer is supplied to a developing sleeve 120 while the developer is made to circulate between a developing chamber 125 and a stirring chamber 126 by conveying screws. This configuration is the same as that of the developing device of FIG. 6, which does not employ the function separation system. However, in the developing device of FIG. 8, which employs the function separation system, the developer that has passed through a development region of a photoconductor while being carried by the developing sleeve 120 is separated from the developing sleeve 120 and then collected so as to be placed, not in the developing chamber 125, but in the stirring chamber 126, as indicated by dashed arrows in FIG. 8. This is a characteristic of a developing device that employs function separation system.

In the developing device, which is illustrated in FIG. 6 and which does not employs the function separation system, the developer that has been supplied to the developing sleeve 120 from the developing chamber 125 returns the developing chamber 125, and thus, the distribution of developer is relatively uniform. However, in the developing device, which is illustrated in FIG. 8 and which employs the function separation system, the developer that has been supplied to the developing sleeve 120 from the developing chamber 125 is collected so as to be placed in the stirring chamber 126, and thus, in the developing chamber 125, the surface angle of the developer is likely to become inclined downward toward a downstream side. As a result, the amount of the developer on the downstream side of the developing chamber 125 that is to be supplied to the developing sleeve 120 is reduced, which in turn may result in coating failure.

Regarding a decrease in the level of a developer in a developer container of a developing device that employs the function separation system, such as that described above, for example, a developing device that is disclosed in Japanese Patent Laid-Open No. 11-84874 (Patent Document 3) has been proposed. Patent Document 3 proposes that, in a developing device, particularly a vertical-stirring-type developing device that employs the function separation system and in which a developing chamber is formed above a stirring chamber, unevenness in developer distribution is corrected by changing the pitch or the diameter of the blade of a conveying screw, which is disposed in the developing chamber.

However, a method for making the unevenness uniform during developer distribution in a developing chamber by changing the pitch or the diameter of the blade of a conveying screw, which is disposed in the developing chamber, such as that described in Patent document 3, has the following problem.

For example, although reducing the pitch of the blade of a conveying screw, which is disposed in a developing chamber, can increase the developer level, as the pitch of the blade is reduced, the inclination angle of the blade with respect to a screw shaft increases. When the inclination angle of the blade of the conveying screw with respect to the screw shaft is small, a force that is applied to the developer by the blade as a result of rotation of the conveying screw increases not only in a direction parallel to the screw shaft, but also in a direction perpendicular to the screw shaft. This force affects the ability of the blade to supply the developer to a developing sleeve. However, when the inclination angle of the blade of the conveying screw with respect to the screw shaft is large, the force that is applied to the developer by the blade as a result of rotation of the conveying screw concentrates in the direction perpendicular to the screw shaft, and thus, the ability of the blade to supply the developer to the developing sleeve decreases.

As described above, there is a concern that, if the pitch of the blade in the developing chamber is reduced, or if the diameter of the blade is changed, the ability of the blade to supply the developer to the developing sleeve also changes in response to these changes. Thus, there is a concern that, even if the developer level can be increased by changing the pitch or the diameter of the blade, at the same time, the ability of the blade to supply the developer to the developing sleeve also changes, and as a result, the advantageous effect of improving coating of the developing sleeve is limited.

Accordingly, a configuration in which the pitch of the blade in the developing chamber is reduced or the diameter of the blade is changed in an area outside a developer carrying area of the developing sleeve in a direction parallel to the rotation axis of the developing sleeve may also be considered. However, although a decrease in the level of the developer in the area outside the developer carrying area of the developing sleeve can be suppressed with the above-described configuration, the configuration is not sufficiently effective for the level of the developer in the developer carrying area of the developing sleeve.

SUMMARY OF THE INVENTION

Accordingly, the present invention provides a horizontal-stirring-type developing device that employs the function separation system and that has a configuration that suppresses a decrease in developer level on a downstream side in a developing chamber in a direction in which a developer is conveyed while suppressing a decrease in an ability to supply the developer to a developer-carrying member.

The present invention provides a developing device including a developer-carrying member that is rotatably arranged, that carries a developer, which includes toner and carrier, and that supplies the developer to a development region, which faces an image-bearing member, a developing chamber in which the developer is supplied to the developer-carrying member at a position facing a circumferential surface of the developer-carrying member, a collecting chamber that is positioned upstream of the developing chamber in a rotation direction of the developer-carrying member in such a manner as to face the circumferential surface of the developer-carrying member, in which the developer that has been collected from the developer-carrying member is placed, and in which a circulation path that allows the developer to circulate through communicating portions, which allow communication between the collecting chamber and the developing chamber at opposite ends of the chambers, is formed, a partitioning wall that separates the developing chamber and the collecting chamber from each other, a first screw that is rotatably arranged in the developing chamber and that conveys the developer, and a second screw that is rotatably arranged in the collecting chamber and that conveys the developer.

In an axial direction of the developer-carrying member, a developer carrying area of the developer-carrying member is superposed with one of the communicating portions, which is a downstream communicating portion through which the developer is conveyed from the developing chamber to the collecting chamber, and a conveying ability of the second screw in a first area that includes an area, which is superposed with the developer carrying area of the developer-carrying member and the downstream communicating portion in the axial direction of the developer-carrying member, is lower than the conveying ability of the second screw in a second area, which is positioned further downstream than the first area in a direction in which the developer is conveyed and which is superposed with the developer carrying area of the developer-carrying member, or is zero, or a direction in which the second screw conveys the developer in the first area and a direction in which the second screw conveys the developer in the second area are opposite to each other.

Further features of the present invention will become apparent from the following description of exemplary embodiments with reference to the attached drawings.

DESCRIPTION OF THE EMBODIMENTS

Embodiments of the present invention will be described in detail below with reference to the drawings.

First Embodiment

Figure 1:
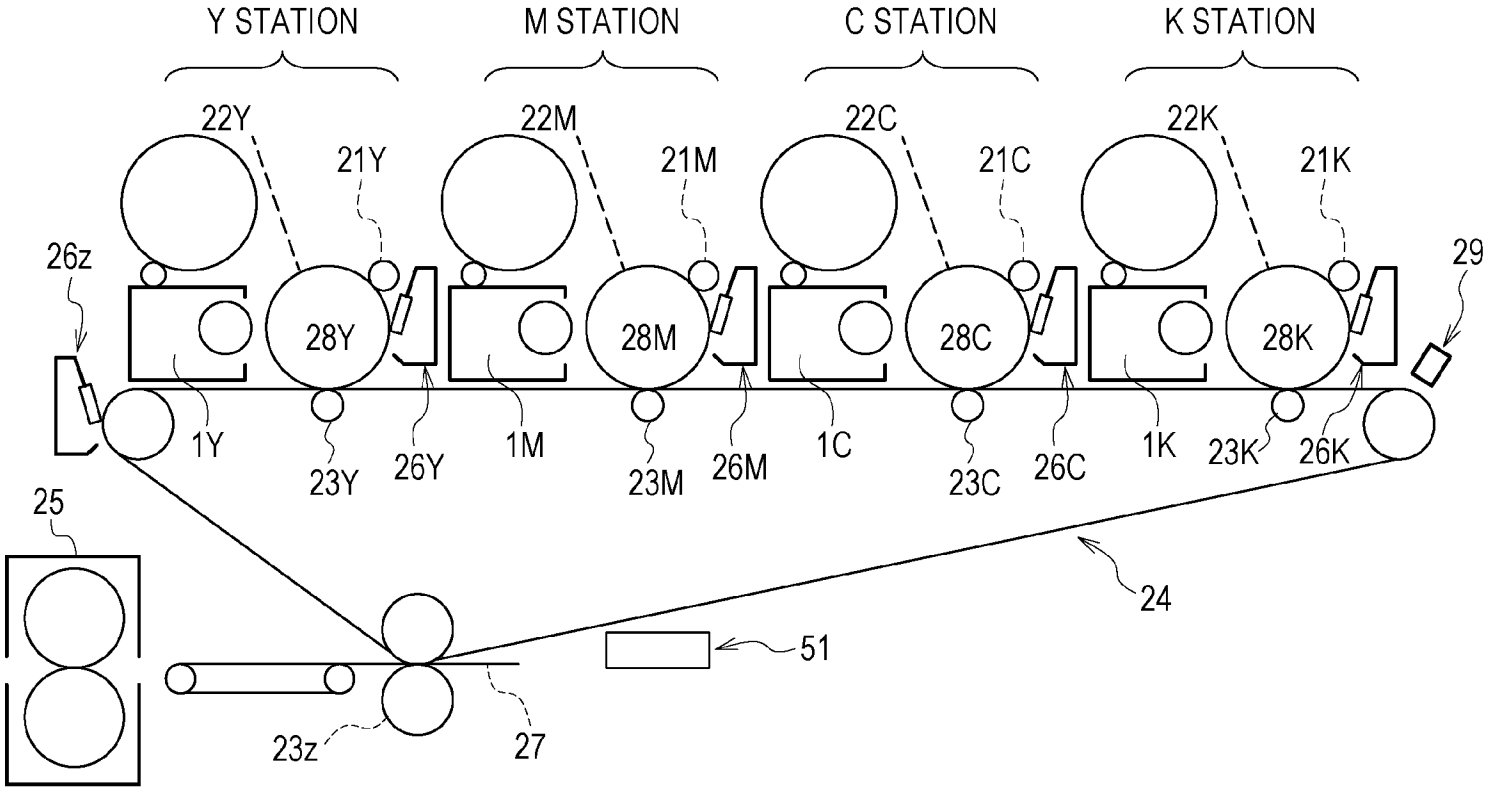
FIG. 1 is a diagram illustrating an example of an image forming apparatus that includes a developing device according to a first embodiment of the present invention.

As illustrated in FIG. 1, a developing unit according to a first embodiment is used in a full-color image forming apparatus that employs a so-called tandem system. In the developing device, drum cartridges each of which corresponds to one of four colors of yellow, magenta, cyan, and black, and each of which performs processing for forming a toner image of the corresponding color are arranged side-by-side. The toner images of the four colors are superposed with one another on an intermediate transfer belt 24 and collectively transferred onto a transfer sheet. Then, the transfer sheet, to which the toner images have been transferred, is applied with pressure and heated by a fixing unit 25, so that a full-color image is obtained. In the following description, components that are common to the drum cartridges illustrated in FIG. 1, each of which corresponds to one of the four colors of yellow, magenta, cyan, and black, will be simply indicated by reference numerals, and reference letters Y, M, C, and K will be omitted.

[Image Forming Apparatus]

An image forming apparatus of the present embodiment will be described below. FIG. 1 is a diagram illustrating a toner image forming operation of each of the drum cartridges. Primary chargers 21 that serve as charging devices charge surfaces of photoconductor drums 28 that serve as image-bearing members. Then, the surfaces of the photoconductor drums 28 are exposed to laser beams by lasers 22 that serve as exposure devices, and consequently, electrostatic latent images are formed on the photoconductor drums 28. These electrostatic latent images are developed by developing units 1 that serve as developing devices, so that toner images are obtained. The toner images are transferred onto the intermediate transfer belt 24 in such a manner that the toner images are superposed with one another by primary transfer rollers 23 that serve as transfer units. Residual toner that remains on the photoconductor drums 28 after the toner images have been transferred is removed by cleaners 26.

[Developing Device]

The developing units 1 of the present embodiment will be described in detail with reference to FIG. 2 and FIG. 3. Each of the developing units 1 includes a developer container 2 that contains a two-component developer and a developing sleeve 3 that serves as a developer-carrying member and that is arranged in an opening of the developer container 2. Regarding the developer, in the present embodiment, a two-component development system is employed as a development system, and a mixture of non-magnetic toner having a negative charge polarity and magnetic carrier is used as the developer. The non-magnetic toner is powder that is formed by grinding or polymerizing a resin such as a polyester resin, a styrene-acrylic resin, or the like that contains a colorant, a wax component, and the like. The magnetic carrier is formed by coating, with a resin, surface layers of cores that include resin particles, which are obtained by kneading ferrite particles and magnetic powder. In the present embodiment, the toner density of the developer in an initial state (the weight ratio of toner that is included in the developer in an initial state) is 8%.

In the opening of the developer container 2, which is a portion that faces a corresponding one of the photoconductor drums 28 and that is open, the developing sleeve 3 is rotatably arranged in such a manner as to be partially exposed. The developing sleeve 3 is made of a non-magnetic material and includes a stationary magnet 4 that serves as a magnetic field generating unit therein. The developing sleeve 3 rotates in the direction of arrow B in FIG. 2 and conveys the developer, which has been caused to be held on the developing sleeve 3 at a position corresponding to a pumping magnetic pole N1 of the stationary magnet 4, in a direction toward a blade 5. The developer that has been napped by a regulating magnetic pole S1 is subjected to a shearing force from the blade 5, so that the amount of the developer is regulated, and after the developer has passed through a gap between the developing sleeve 3 and the blade 5, a developer layer that has a predetermined layer thickness is formed on the developing sleeve 3. The developer layer is carried to a development region that faces the photoconductor drum 28 and develops an electrostatic latent image that has been formed on a surface of the photoconductor drum 28 while being caused to form a magnetic brush by a developing magnetic pole N2. The developer that has been used for the development is separated from the developing sleeve 3 in a magnetic-force-free zone that is defined between a releasing magnetic pole N3 and the pumping magnetic pole N1 as a result of these poles being adjacent to each other.

The developer container 2 is divided by a partitioning wall 15 into a developing chamber 11 (a first developer containing chamber) and a stirring chamber 12 (a second developer containing chamber) that serves as a collecting chamber. Each of the developing units 1 of the present embodiment is a developing device that employs a so-called function separation system. In other words, in each of the developing units 1, the developer is supplied to the developing sleeve 3 at a position in the developing chamber 11 that faces a circumferential surface of the developing sleeve 3. The developer is collected so as to be placed in the stirring chamber 12 from the developing sleeve 3 at a position that faces the circumferential surface of the developing sleeve 3.

The developing chamber 11 and the stirring chamber 12 extend in a direction parallel to the rotation axis of the developing sleeve 3. Both the ends of the partitioning wall 15 do not reach inner side walls of the developer container 2 that are positioned at the ends in the longitudinal direction of the developer container 2, so that an upstream communicating portion 17 and a downstream communicating portion 18 that allow the developer to pass through between the developing chamber 11 and the stirring chamber 12 are formed. In the developing chamber 11 and the stirring chamber 12, a circulation path that allows the developer to circulate between the developing chamber 11 and the stirring chamber 12 is formed. A first screw 13 and a second screw 14 that serve as conveying members are disposed in the developing chamber 11 and the stirring chamber 12, respectively. The developing sleeve 3, the first screw 13, and the second screw 14 are configured to be driven in conjunction with one another by a gear train (not illustrated) and rotate by receiving a driving force from a developing-unit-driving gear (not illustrated). Rotations of the first and second screws 13 and 14 cause the developer to circulate and to be mixed and stirred within the developer container 2.

In the present embodiment, the first screw 13 and the second screw 14 are disposed at positions where the first screw 13 and the second screw 14 are superposed with each other when viewed from the horizontal direction. In addition, in the present embodiment, the first screw 13 and the second screw 14 are disposed at positions where the center of rotation of at least one of the screws is superposed with the blade of the other one of the screws when viewed from the horizontal direction. As described above, the first screw 13 and the second screw 14 are substantially horizontally arranged. Compared with the case where the first screw 13 and the second screw 14 are arranged side-by-side in the vertical direction, the influence of conveying the developer against gravity can be reduced, and developer conveyance performance can be improved.

A guiding member 16, which is an upper portion of the partitioning wall 15, is positioned adjacent to the developing sleeve 3 in the vicinity of the magnetic-force-free zone of the developing sleeve 3 and is configured to cause the developer on the developing sleeve 3 not to return to the developing chamber 11 but to be contained in the stirring chamber 12 after the developer has been separated from the developing sleeve 3 by the releasing magnetic pole N3.

In other words, an end portion of the partitioning wall 15 is positioned above the second screw 14 in the vertical direction in such a manner as to face the developing sleeve 3. In addition, the partitioning wall 15 guides the developer that has been collected from the developing sleeve 3 to the stirring chamber 12.

As stated above, in such a developing device that employs the function separation system, there has been a problem in that uneven distribution of the developer level occurs.

In particular, in the present embodiment, an area in which the developing sleeve 3 is to be coated with the developer (hereinafter referred to as a developer coating area) is superposed with the upstream and downstream communicating portions 17 and 18, which allow the developer to pass through between the developing chamber 11 and the stirring chamber 12. Thus, as stated above, in the case of changing the pitch or the diameter of the blade of the first screw 13 in the developing chamber 11, the influence in terms of supplying the developer to the developing sleeve 3 cannot be ignored.

[Configuration of Screw in Downstream Communicating Portion on Downstream Side in Developing Chamber]

A characteristic configuration of each of the developing units 1 according to the present embodiment will now be described. In the present embodiment, each of the developing units 1 has the following configuration in order to increase the developer level on the downstream side in the developing chamber 11, particularly on the downstream side in the developer coating area. In other words, in the configuration of each of the developing units 1 of the present embodiment, which is a horizontal-stirring-type developing device in which the developing chamber 11 and the stirring chamber 12 are substantially horizontally arranged, the downstream communicating portion 18 that is used for conveying the developer from the developing chamber 11 to the stirring chamber 12 is positioned so as to be superposed with the developer coating area, which serves as a developer carrying area, in the direction parallel to the rotation axis of the developing sleeve 3.

In the stirring chamber 12, the ability of the second screw 14 to convey the developer in a first area that is at least part of a facing area in which the second screw 14 faces the downstream communicating portion 18 is set to be lower than that in a second area that is adjacent to the first area on the downstream side in a conveyance direction in which the developer is conveyed. In addition, the conveying ability of the second screw 14 in the facing area, in which the second screw 14 faces the downstream communicating portion 18, is set to be lower than that of the second screw 13. In the present embodiment, some of the blade of the second screw 14 is omitted in the first area in such a manner as to make the second screw 14 lose its conveying ability in the first area.

With this configuration, a portion of the first screw 13 that faces the downstream communicating portion 18, which allows communication between the developing chamber 11 and the stirring chamber 12, can convey a larger amount of the developer than a portion of the second screw 14 that faces the downstream communicating portion 18 in the direction in which the developer is conveyed. Therefore, the developer is likely to stay in an area including the upstream side and the downstream side of the downstream communicating portion 18, and the level of the developer in the developing chamber 11 can be increased without changing the pitch or the diameter of the blade of the first screw in the developing chamber 11. In addition, a configuration in which some of the blade of the second screw 14 at a position facing the developer coating area is omitted can be employed, and a decrease in the developer level in the developer coating area can be effectively suppressed.

In the present embodiment, the downstream communicating portion 18 through which the developer is conveyed from the developing chamber 11 to the stirring chamber 12 and the developer coating area are superposed with each other. In addition, the portion of the second screw 14, which faces the downstream communicating portion 18, is set to be capable of conveying a smaller amount of the developer than the amount of the developer that is conveyed in upstream and downstream of the portion in a direction in which the developer circulates. In other words, the conveying ability of the portion of the second screw 14, which faces the downstream communicating portion 18, is set to be lower than that of the portion of the first screw 13, which faces the downstream communicating portion 18. In addition, the conveying ability of the portion of the second screw 14, which faces the downstream communicating portion 18, is set to be lower than that of a portion of the second screw 14 that is positioned downstream of the portion. Therefore, in the conveyance direction, the developer level on the downstream side in the developing chamber 11 in the developer coating area can be effectively increased. In this case, such an improvement of the second screw 14 in the stirring chamber 12 will not affect the ability of the developing unit 1 to supply the developer to the developing sleeve 3.

In the present embodiment, in order to make the second screw 14, which is disposed in the stirring chamber 12, lose its ability to convey the developer in an area (hereinafter referred to as A area), which is A in FIG. 3 and which is in the vicinity of the downstream communicating portion 18 formed between the developing chamber 11 and the stirring chamber 12, some of the blade of the second screw 14 is omitted. In the case where the blade of the second screw 14 that is positioned in the vicinity of the downstream communicating portion 18 is omitted, the developer in the A area cannot receive a force that causes the developer to be conveyed from the blade of the second screw 14, and thus, the developer is likely to stay where it is without being conveyed. In addition, like a traffic jam, the developer that is present upstream of the A area is less likely to be conveyed due to the influence of the developer that has stayed in front of the developer, and thus, an increase in the developer level on the downstream side in the developing chamber 11, which is positioned upstream of the A area, can be expected. However, in the case where the momentum of the developer that is conveyed from upstream of the A area is large, accumulation of the developer is less likely to occur, and thus, the level of the developer surface upstream of the A area cannot be increased very much. In the configuration of the present embodiment, the A area in which the blade of the second screw 14 is omitted is present not in the developing chamber 11, but the stirring chamber 12 in the vicinity of the downstream communicating portion 18, and thus, the A area is positioned along a direction perpendicular to the direction in which the developer is conveyed in the developing chamber 11. Therefore, the momentum of the developer, which is conveyed, is less likely to be transmitted to the A area, in which the blade of the second screw 14 is omitted, in the stirring chamber 12, and as a result, accumulation of the developer is likely to occur.

Figure 2:
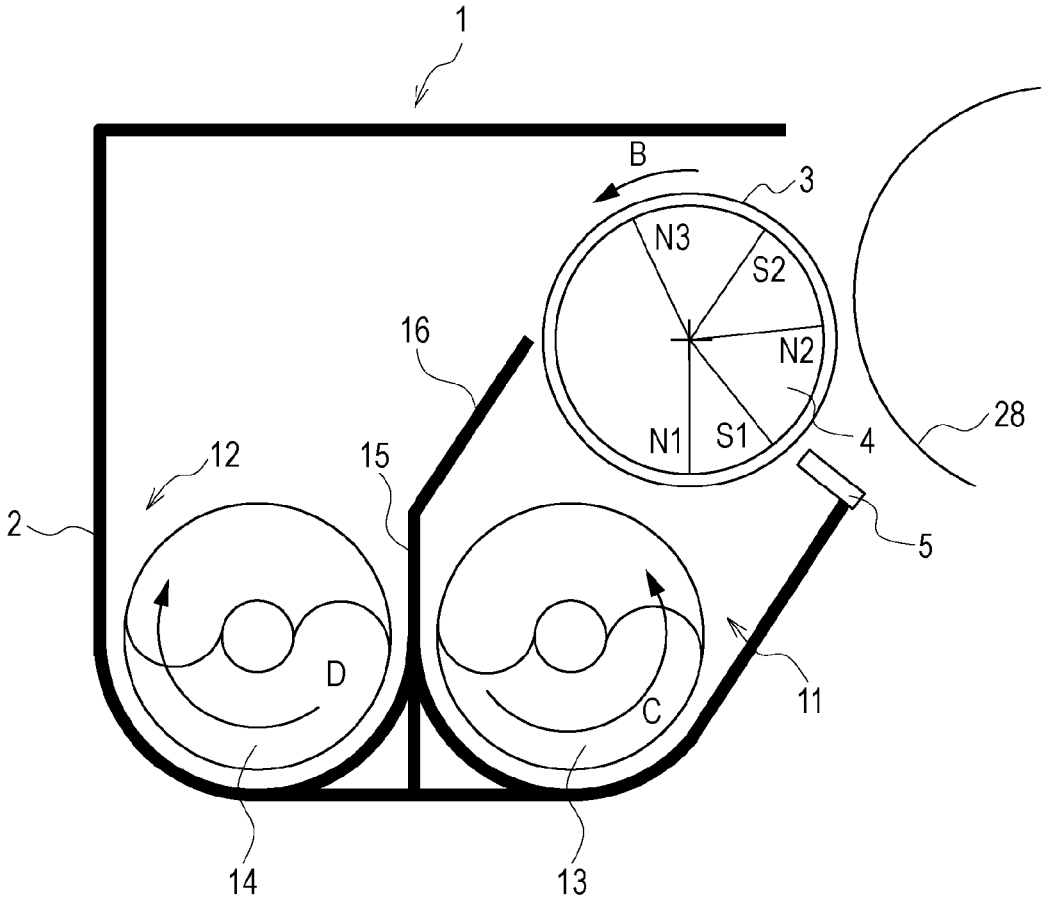
FIG. 2 is a diagram illustrating the developing device according to the first embodiment.
Figure 3:
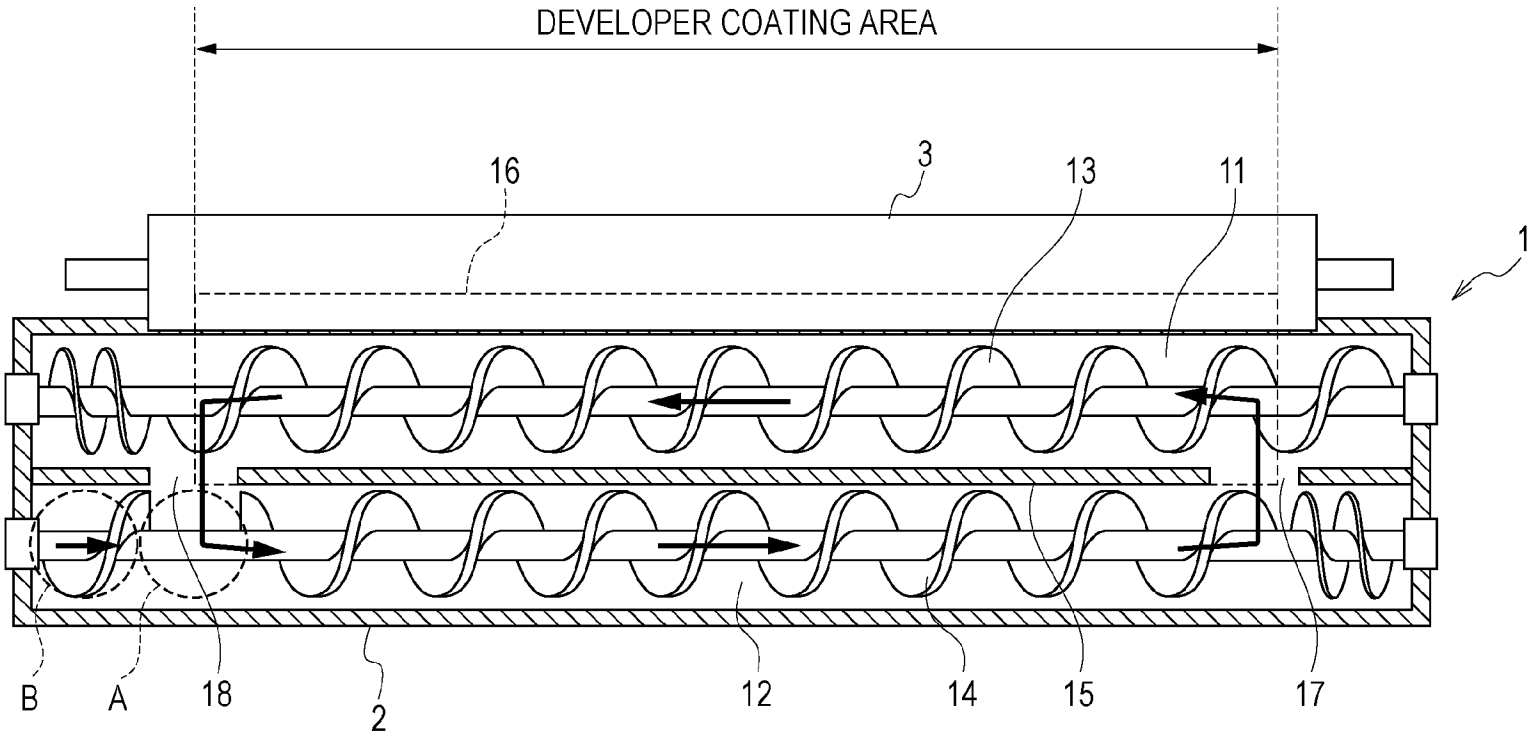
FIG. 3 is a diagram illustrating the developing device according to the first embodiment.

In the present embodiment, the direction of rotation of the first screw 13 in the developing chamber 11 is the direction of arrow C in FIG. 2. This is because, in an area below the first screw 13 in which the developer is present, the momentum of the developer, which is conveyed in the developing chamber 11, is further less likely to be transmitted to the stirring chamber 12 as a result of the blade of the first screw 13 rotating in a direction away from the stirring chamber 12. This configuration further increases the probability that the developer will accumulate.

The developer level on the downstream side in the developing chamber 11, particularly in the developer coating area was effectively increased by employing the configuration of the present embodiment.

In order to obtain the advantageous effects of the present invention, at least part of the A area in the stirring chamber 12, in which the blade of the second screw 14 is omitted, may face part of the downstream communicating portion 18 between the developing chamber 11 and the stirring chamber 12 in the developer coating area. The advantageous effects of the present invention can be obtained as long as at least the part of the A area in the stirring chamber 12, in which the blade of the second screw 14 is omitted, faces the downstream communicating portion 18. However, the blade of the second screw 14 may be omitted in the entire area in which the second screw 14 faces the downstream communicating portion 18. In other words, the entire first area, in which the blade of the second screw 14 is omitted, may be included in the downstream communicating portion 18.

In the present embodiment, in the stirring chamber 12, a blade that conveys the developer in the same direction as that in which other portions of the second screw 14 conveys the developer (the same direction as the developer conveyance direction in the stirring chamber 12) is disposed in an area (hereinafter referred to as B area), which is B in FIG. 3 and which is positioned further upstream than the A area in which the blade of the second screw 14 is omitted in the developer conveyance direction in the stirring chamber 12. This blade can suppress flowing of the developer that has stayed in the A area, in which the blade of the second screw 14 is omitted, into the B area, which is positioned upstream of the A area. As a result, a larger amount of the developer can stay in the A area, in which the blade of the second screw 14 is omitted and where accumulation of the developer occurs, and accumulation of the developer in the developing chamber 11 is likely to be induced.

In addition, this blade is also configured to, by rotating, supply a force to the developer in the A area, in which the blade of the second screw 14 is omitted, in such a manner that the developer slowly flows toward the downstream side in the stirring chamber 12. As a result, the developer in the A area, in which the blade of the second screw 14 is omitted, receives a force in a direction parallel to a shaft of the second screw 14, and thus, occurrence of flowing back of the developer into a portion of the developing chamber 11 that is positioned along a direction perpendicular to the shaft of the second screw 14 can be suppressed. However, in the case where the force that is supplied to the developer by the blade is too large, the developer is less likely to stay in the A area, in which the blade of the second screw 14 is omitted, and as a result, the level of the developer surface in the developing chamber 11 may not be increased very much. Regarding this matter, the blade, which is positioned upstream of the A area, may be disposed so as not to be superposed with the downstream communicating portion 18. Since an area upstream of the downstream communicating portion 18 in the stirring chamber 12 is positioned outside the circulation path, the amount of the toner that is present in the area is small. Therefore, the developer in the A area, in which the blade of the second screw 14 is omitted, receives the force from the blade, which is positioned at the area outside the circulation path, via a force that causes the developer that leaks from the downstream communicating portion 18 to flow back, and thus, the developer can slowly flow.

In addition, in the present embodiment, a supplementary toner is supplied to the B area in which the blade is disposed and which is positioned upstream of the A area in the stirring chamber 12, in which the blade of the second screw 14 is omitted.

As mentioned above, the advantageous effects of the present invention can be obtained as long as the developing chamber 11 and the stirring chamber 12 are substantially horizontally arranged, and in the case where the developing chamber 11 and the stirring chamber 12 are arranged in such a manner as to be superposed with each other in the top-bottom direction, the level of the developer surface in the downstream communicating portion 18 may decrease due to the influence of gravity, resulting in a decrease in the level of the developer surface in the developer coating area. Here, the term "substantially horizontally arranged" refers to setting the inclination angle of the bottom surface of the downstream communicating portion 18 between the developing chamber 11 and the stirring chamber 12 with respect to the horizontal direction to be about 30 degrees or smaller. When the inclination angle is larger than about 30 degrees, it becomes difficult to cause the developer to stay in the vicinity of the downstream communicating portion 18, or it becomes difficult to contribute to an increase in the level of the developer surface in the developing chamber 11, and thus, the advantageous effects of the present invention is less likely to be obtained. The inclination angle is preferably 15 degrees or smaller. This holds true both in the case where the developing chamber 11 is positioned above the stirring chamber 12 and in the case where the developing chamber 11 is positioned below the stirring chamber 12.

Although the case in which some of the blade of the second screw 14 in the stirring chamber 12 is omitted has been described in the present embodiment, the present invention is not limited to this. For example, a configuration in which the diameter of the blade of the second screw 14 in an area in the stirring chamber 12, in which the blade of the second screw 14 is omitted in the first embodiment, is set to be smaller than that of the blade of the second screw 14 in other areas in the stirring chamber 12 in such a manner as to reduce the conveying ability of the second screw 14 in a direction in which the developer circulates, so that the developer is caused to stay in the area may be employed. Instead of changing the diameter of the blade of the second screw 14, the pitch of the blade may be changed. In both the cases, the conveying ability of the second screw 14 is set to be lower than that of the second screw 13 at a position in the downstream communicating portion 18 that faces the developer coating area. In addition, in this case, the conveying ability of the second screw 14 in an area in which the second screw 14 faces the downstream communicating portion 18 is set to be lower than that in an area that is positioned downstream of the area.

Although in the configuration of the present embodiment, a partitioning wall is disposed between the downstream communicating portion 18 through which the developer is conveyed from the developing chamber 11 to the stirring chamber 12 and the corresponding inner side wall of the developer container 2, a configuration in which such a partition wall is not disposed may be employed.

Second Embodiment

Overviews of an image forming apparatus and developing devices of a second embodiment are the same as those of the first embodiment, and descriptions thereof will be omitted. Configurations of the developing devices of the second embodiment different from those of the developing devices of the first embodiment will now be described.

Figure 4:
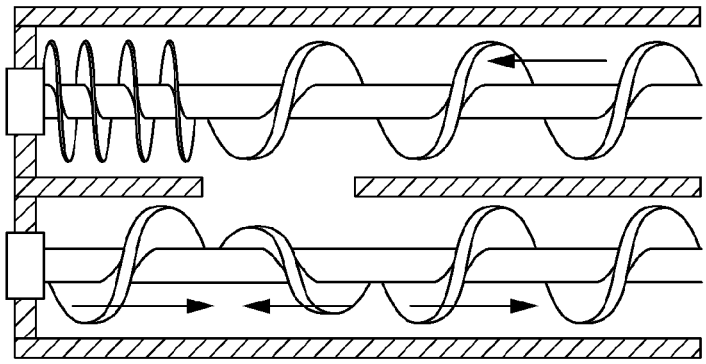
FIG. 4 is a diagram illustrating a developing device according to a second embodiment.
Figure 5:
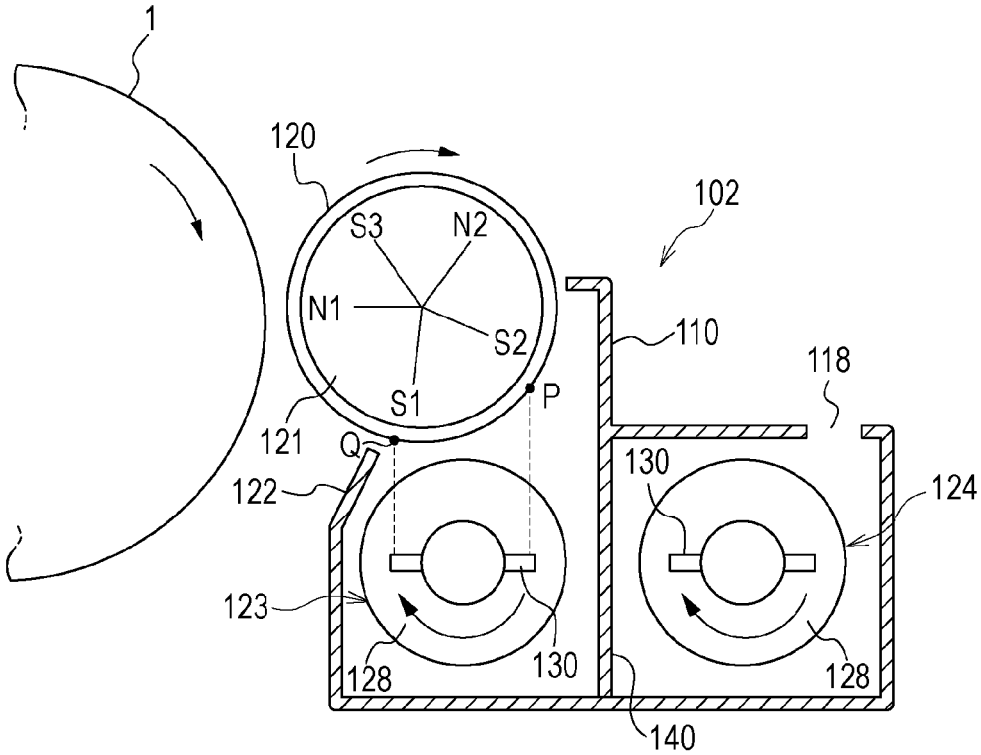
FIG. 5 RELATED ART
FIG. 5 is a diagram illustrating a developing device of the related art.
Figure 6:
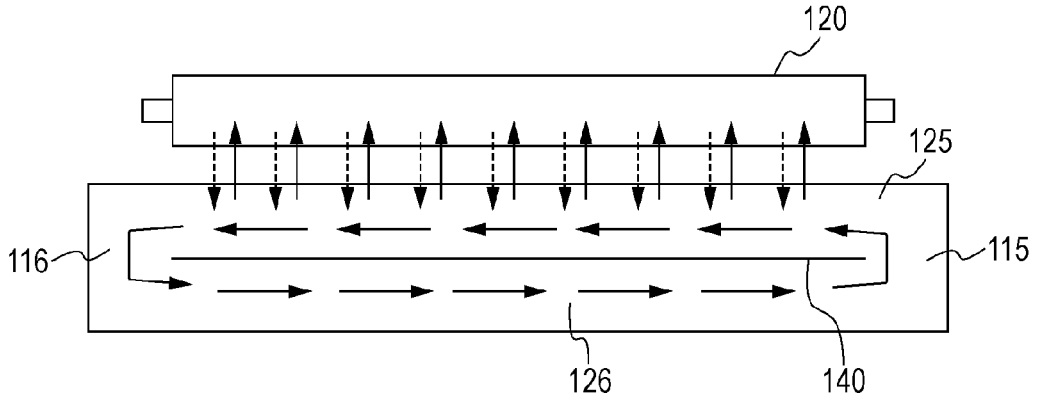
FIG. 6 RELATED ART
FIG. 6 is a diagram illustrating circulation of a developer in the developing device of the related art.
Figure 7:
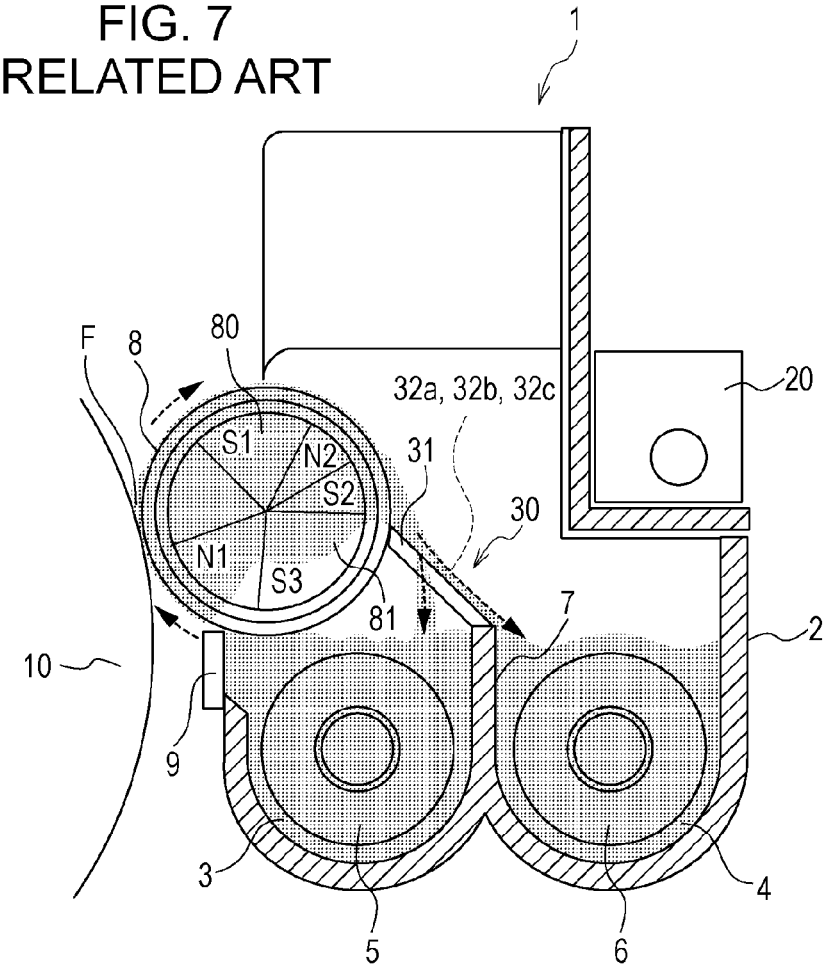
FIG. 7 RELATED ART
FIG. 7 is a diagram illustrating another developing device of the related art that employs a function separation system.
Figure 8:
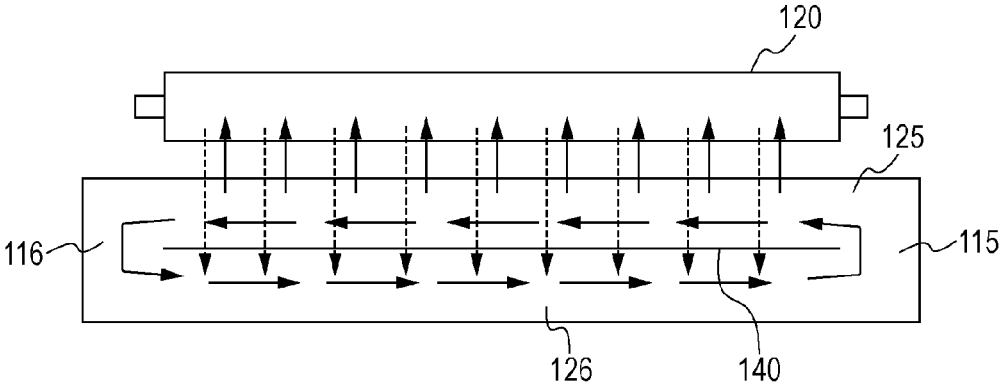
FIG. 8 RELATED ART
FIG. 8 is a diagram illustrating circulation of a developer in the other developing device of the related art, which employs the function separation system.

FIG. 4 is an enlarged view of an area in the vicinity of the downstream communicating portion 18 between the developing chamber 11 and the stirring chamber 12, which is a characteristic portion of one of the developing devices according to the second embodiment. A difference between the second embodiment and the first embodiment is that a helical blade that is wound in a direction opposite to the direction in which the blade of the second screw 14 is wound is formed in the area, in which some of the blade of the second screw 14 is omitted in the first embodiment, in such a manner as to form the flow of the developer in a direction opposite to the developer circulation direction. The rest of the configuration of the second embodiment is the same as that of the first embodiment.

Such a configuration can more effectively cause the developer that is present in the vicinity of the downstream communicating portion 18 to stay where it is than that of the first embodiment. However, if an excessive amount of the developer is conveyed in the opposite direction, the developer in the stirring chamber 12 may flow back into the developing chamber 11. Accordingly, in the present embodiment, the diameter of the blade, which is wound in the direction opposite to the direction in which the other blades are wounded, is smaller than that of the other blades. With this configuration, accumulation of the developer can slowly occur.

In the present embodiment, the direction of rotation of the second screw 14 in the stirring chamber 12 is the direction of arrow D in FIG. 2.

This is because, in an area below the second screw 14 in which the developer is present, the momentum of the developer, the blade of the second screw 14 rotates in a direction away from the developing chamber 11, so that the developer can be prevented from flowing back into the developing chamber 11.

Also with this configuration, uneven distribution of the level of developer in the developing chamber 11 can be suppressed, and the probability of coating failure can be reduced.

According to the present invention, a horizontal-stirring-type developing device that employs the function separation system and that has a configuration that suppresses a decrease in developer level on a downstream side of a developing chamber in a direction in which a developer is conveyed while suppressing a decrease in an ability to supply the developer to a developer-carrying member can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-257155, filed Dec. 12, 2013, which is hereby incorporated by reference herein in its entirety.

What is claimed is:

1. A developing device comprising:

a developer-carrying member configured to carry a developer and to develop a latent image;

a first chamber configured to accommodate a developer to be supplied to the developer-carrying member, the first chamber including a first opening, which is formed at a position facing a circumferential surface of the developer-carrying member and through which a developer can be supplied to the developer-carrying member;

a second chamber arranged next to the first chamber, the second chamber including a second opening, which is formed at a position facing the circumferential surface of the developer-carrying member and through which a developer carried by the developer-carrying member can be collected;

a partitioning wall configured to separate the first chamber and the second chamber from each other;

a first communication portion that is formed at one side of the partitioning wall in an axial direction of the developer-carrying member, and that allows communication between the first chamber and the second chamber;

a second communication portion that is formed at the other side of the partitioning wall in the axial direction of the developer-carrying member, and that allows communication between the first chamber and the second chamber;

a first screw that is rotatably arranged in the first chamber and that conveys the developer in a first direction from the first communication portion toward the second communication portion; and a second screw that is rotatably arranged in the second chamber and that conveys the developer in a second direction which is an opposite direction from the first direction, wherein, in the axial direction of the developer-carrying member, a developer carrying area of the developer-carrying member is superposed with the second communicating portion, wherein the second screw has a first area that is superposed with both of the developer carrying area of the developer-carrying member, and the second communication portion in the axial direction of the developer-carrying member, and a second area that is positioned further downstream than the first area in the second direction and that is superposed with the developer carrying area of the developer-carrying member, and wherein a helical blade for conveying the developer is not formed in the first area of the second screw while at least one a helical blade for conveying the developer in the second direction is formed in the second area of the second screw.

2. The developing device according to claim 1, wherein the second screw includes the helical blade for conveying the developer in the second direction, at a position upstream of the first area in the second direction.

3. A developing device comprising:

a developer-carrying member configured to carry a developer and to develop a latent image;

a first chamber configured to accommodate a developer to be supplied to the developer-carrying member, the first chamber including a first opening, which is formed at a position facing a circumferential surface of the developer-carrying member and through which a developer can be supplied to the developer-carrying member;

a second chamber arranged next to the first chamber, the second chamber including a second opening, which is formed at a position facing the circumferential surface of the developer-carrying member and through which a developer carried by the developer-carrying member can be collected;

a partitioning wall configured to separate the first chamber and the second chamber from each other;

a first communication portion that is formed at one side of the partitioning wall in an axial direction of the developer-carrying member, and that allows communication between the first chamber and the second chamber;

a second communication portion that is formed at the other side of the partitioning wall in the axial direction of the developer-carrying member, and that allows communication between the first chamber and the second chamber;

a first screw that is rotatably arranged in the first chamber and that conveys the developer in a first direction from the first communication portion toward the second communication portion; and a second screw that is rotatably arranged in the second chamber and that conveys the developer in a second direction which is an opposite direction from the first direction, wherein, in the axial direction of the developer-carrying member, a developer carrying area of the developer-carrying member is superposed with the second communicating portion, wherein the second screw has a first area that is superposed with both of the developer carrying area of the developer-carrying member, and the second communication portion in the axial direction of the developer-carrying member, and a second area that is positioned further downstream than the first area in the second direction and that is superposed with the developer carrying area of the developer-carrying member, and wherein the second screw includes a first helical blade for conveying the developer in the first area, and a second helical blade for conveying the developer in the second direction in the second area, and a conveying ability of the first helical blade in the second direction is lower than a conveying ability of the second helical blade in the second direction.

4. The developing device according to claim 3, wherein a diameter of the first helical blade is smaller than a diameter of the second helical blade.

5. The developing device according to claim 3, wherein the second screw includes a third helical blade for conveying the developer in the second direction, at a position upstream of the first area in the second direction.

6. A developing device comprising:

a developer-carrying member configured to carry a developer and to develop a latent image;

a first chamber configured to accommodate a developer to be supplied to the developer-carrying member, the first chamber including a first opening, which is formed at a position facing a circumferential surface of the developer-carrying member and through which a developer can be supplied to the developer-carrying member;

a second chamber arranged next to the first chamber, the second chamber including a second opening, which is formed at a position facing the circumferential surface of the developer-carrying member and through which a developer carried by the developer-carrying member can be collected;

a partitioning wall configured to separate the first chamber and the second chamber from each other;

a first communication portion that is formed at one side of the partitioning wall in an axial direction of the developer-carrying member, and that allows communication between the first chamber and the second chamber;

a second communication portion that is formed at the other side of the partitioning wall in the axial direction of the developer-carrying member, and that allows communication between the first chamber and the second chamber;

a first screw that is rotatably arranged in the first chamber and that conveys the developer in a first direction from the first communication portion toward the second communication portion; and a second screw that is rotatably arranged in the second chamber and that conveys the developer in a second direction which is an opposite direction from the first direction, wherein, in the axial direction of the developer-carrying member, a developer carrying area of the developer-carrying member is superposed with the second communicating portion, wherein the second screw has a first area that is superposed with both of the developer carrying area of the developer-carrying member, and the second communication portion in the axial direction of the developer-carrying member, and a second area that is positioned further downstream than the first area in the second direction and that is superposed with the developer carrying area of the developer-carrying member, and wherein the second screw includes a first helical blade for conveying the developer in the first direction in the first area, and a second helical blade for conveying the developer in the second direction in the second area.

7. The developing device according to claim 6, wherein the second screw includes a third helical blade for conveying the developer in the second direction, at a position upstream of the first area in the second direction.

* * * * *